US009538787B2

(12) United States Patent
Liu

(10) Patent No.: US 9,538,787 B2
(45) **Date of Patent: *Jan. 10, 2017**

(54) ELECTRONIC CIGARETTE

(71) Applicant: Qiuming Liu, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 726 days.

This patent is subject to a terminal disclaimer.

(21) Appl. No.: 13/894,788

(22) Filed: May 15, 2013

(65) Prior Publication Data

US 2014/0261498 A1 Sep. 18, 2014

Related U.S. Application Data

(63) Continuation of application No. PCT/CN2013/072548, filed on Mar. 13, 2013.

(51) Int. Cl.
*A24F 47/00* (2006.01)

(52) U.S. Cl.
CPC ..... *A24F 47/008* (2013.01)

(58) Field of Classification Search
CPC A61M 15/06; A61M 15/009; A61M 15/0091; A61M 2202/0468; A24F 47/002–47/008
USPC ..... 131/270–273, 194; 128/202.21
See application file for complete search history.

(56) References Cited

U.S. PATENT DOCUMENTS 4,446,878 A * 5/1984 Porenski, Jr. ..... A24D 3/045 131/336
4,540,005 A * 9/1985 Cantrell ..... A24D 3/043 131/336
2011/0303231 A1* 12/2011 Li ..... A24F 47/008 131/329

FOREIGN PATENT DOCUMENTS

CN 2293953 Y 10/1998
CN 1284493 C 11/2006
CN 102458540 A 5/2012
WO 2012142293 A2 10/2012

OTHER PUBLICATIONS

Translation of International Search Report dated Dec. 19, 2013 for Application No. PCT/CN2013/072548.

* cited by examiner

*Primary Examiner* — Michael H Wilson
*Assistant Examiner* — Yana B Krinker
(74) *Attorney, Agent, or Firm* — Tim Tingkang Xia, Esq.; Locke Lord LLP

(57) ABSTRACT

An electronic cigarette includes a sleeve and a cigarette holder cover received in the sleeve, wherein, the sleeve defines at least one inhaling hole at a side surface of an end of the sleeve near the cigarette holder cover, and the cigarette holder cover comprises a cap and a main body extending from a bottom surface of the cap; the main body defines a first groove at an outer surface thereof, the first groove is aligned with the inhaling hole of the sleeve to cooperatively form a channel configured for flowing of smoke, and the channel is configured to guide smoke in the electronic cigarette to reach the inhaling hole and inhaled by a user at a joint of the first groove and the inhaling hole.

9 Claims, 5 Drawing Sheets

ELECTRONIC CIGARETTE

CROSS-REFERENCE TO RELATED APPLICATIONS

This application is a continuation of International Patent Application No. PCT/CN2013/072548, with an international filing date of Mar. 13, 2013, designating the United States, now pending. The contents of these specifications are incorporated herein by reference.

BACKGROUND

1. Technical Field

The present disclosure relates to electric heating products, and particularly, to an electronic cigarette for changing flowing direction of an atomized smoke.

2. Description of Related Art

Because of enhancing of anti-smoking advertising and raising of people health awareness, electronic cigarettes are used more and more widely as a cigarette substitute. An existing electronic cigarette includes a cigarette rod and a cigarette holder. The cigarette rod includes a battery, and the cigarette holder includes an atomizer electrically connected with the cigarette rod and a cup for filling cigarette liquid. When inhaling from the cigarette holder, the cigarette liquid flows to the atomizer, and the atomizer starts to heat the cigarette liquid by a control circuit of the cigarette rod, and the atomized smoke is generated and inhaled through a cover of the cigarette holder.

Generally, the atomized smoke is inhaled through a centre of the cover of the cigarette holder, thereby it is easy to inhale the cigarette liquid, and smoker may feel uncomfortable because of inhaling the excess atomized smoke.

Therefore, there is room for improvement within the art.

SUMMARY OF THE INVENTION

The object of the present invention is to provide an electronic cigarette changing the flowing direction of atomized smoking by changing an internal structure thereof, thereby preventing the atomized smoke from directly flowing in mouth, which improves the smoker experience.

The invention relates to an electronic cigarette, characterized in that the electronic cigarette includes:

a sleeve and a cigarette holder cover received in the sleeve, wherein, the sleeve defines at least one inhaling hole at a side surface of an end of the sleeve near the cigarette holder cover, and the cigarette holder cover comprises a cap and a main body extending from a bottom surface of the cap; the main body defines a first groove at an outer surface thereof, the first groove is aligned with the inhaling hole of the sleeve to cooperatively form a channel configured for flowing of smoke, and the channel is configured to guide smoke in the electronic cigarette to reach the inhaling hole and inhaled by a user at a joint of the first groove and the inhaling hole.

The first groove is a circular groove defined at an outer surface of the main body.

The main body defines the at least two first grooves spaced from each other at the outer surface of the main body, and the first grooves correspond to the inhaling holes one by one.

The main body further defines at least one second groove at a side of the first groove opposite to the cap, and the second groove corresponds to and communicates with the first groove.

The number of the second grooves is four, and the second grooves are spaced from each other.

The electronic cigarette further comprises a seal ring, the cigarette holder cover further comprises a first connecting portion connected with the seal ring; and the first connecting portion defines a third groove communicating with the second groove.

The first connecting portion configures a buckle, an inner surface of the sleeve defines a notch corresponding to the buckle, and the buckle and the notch cooperatively define a buckle connection.

The first connecting portion defines a notch, an inner surface of the sleeve configures a buckle corresponding to the notch, and the buckle and the notch cooperatively define a buckle connection.

The cap, the main body and the first connecting portion are integrally formed.

The electronic cigarette further comprises a seal ring, the cigarette holder cover further comprises a second connecting portion connected with the seal ring; the second connecting portion defines a gap communicating with the first groove for the atomized smoke flowing.

The number of the gaps is four.

The gaps are spaced from each other.

The main body and the second connecting portion are integrally formed.

The inhaling hole is circular, kidney, polygonal, or elliptic shaped.

The electronic cigarette described-above has many benefits. Because the sleeve defines the at least one inhaling hole, and the main body defines the first groove, when the cigarette holder cover is embedded within the sleeve, the first groove communicates with the inhaling holes to cooperatively form the channel for the atomized smoke flowing, thereby, the atomized smoke will not be inhaled through the centre of the cap but be inhaled through the inhaling holes. Namely, the atomized smoke can be inhaled by deflected through certain angle, which avoids inhaling the cigarette liquid and filters small particles contained in the atomized smoke to leave in the electronic cigarette. The present invention prevents the atomized smoke from directly flowing in mouth, which improves the smoker experience.

DETAILED DESCRIPTION OF THE EMBODIMENTS

Figure 1:
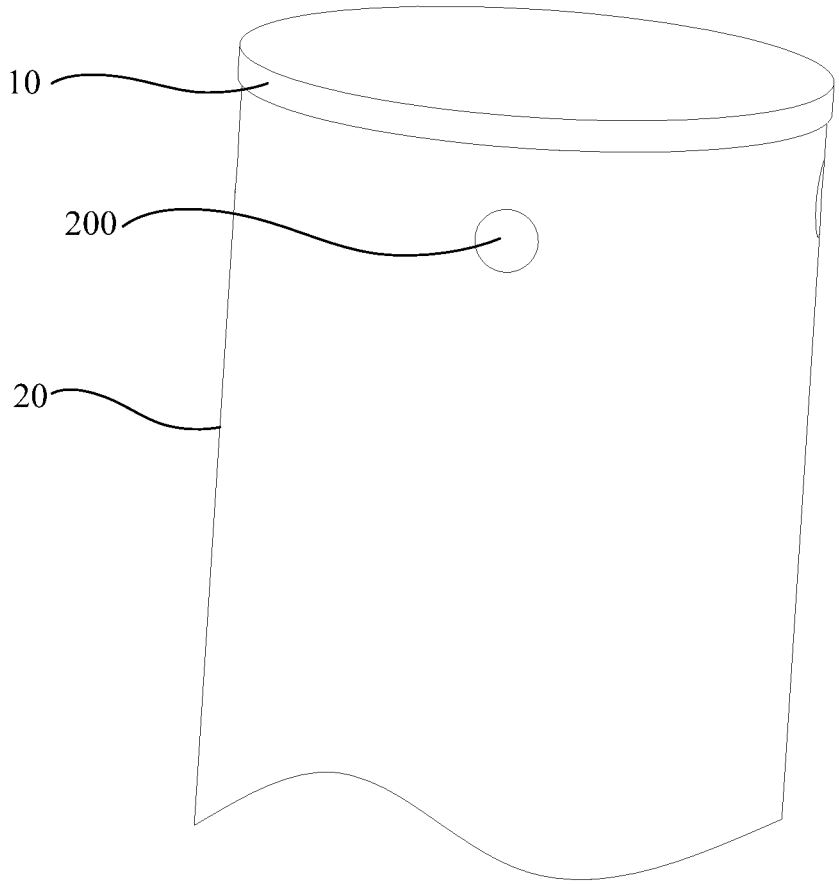
FIG. 1 is a partial, isometric view of an electronic cigarette.

In order to understand the technical features, purpose and the effect of the present invention more clearly, the specific embodiments of the present invention will be described referring to the drawings.

Figure 2:
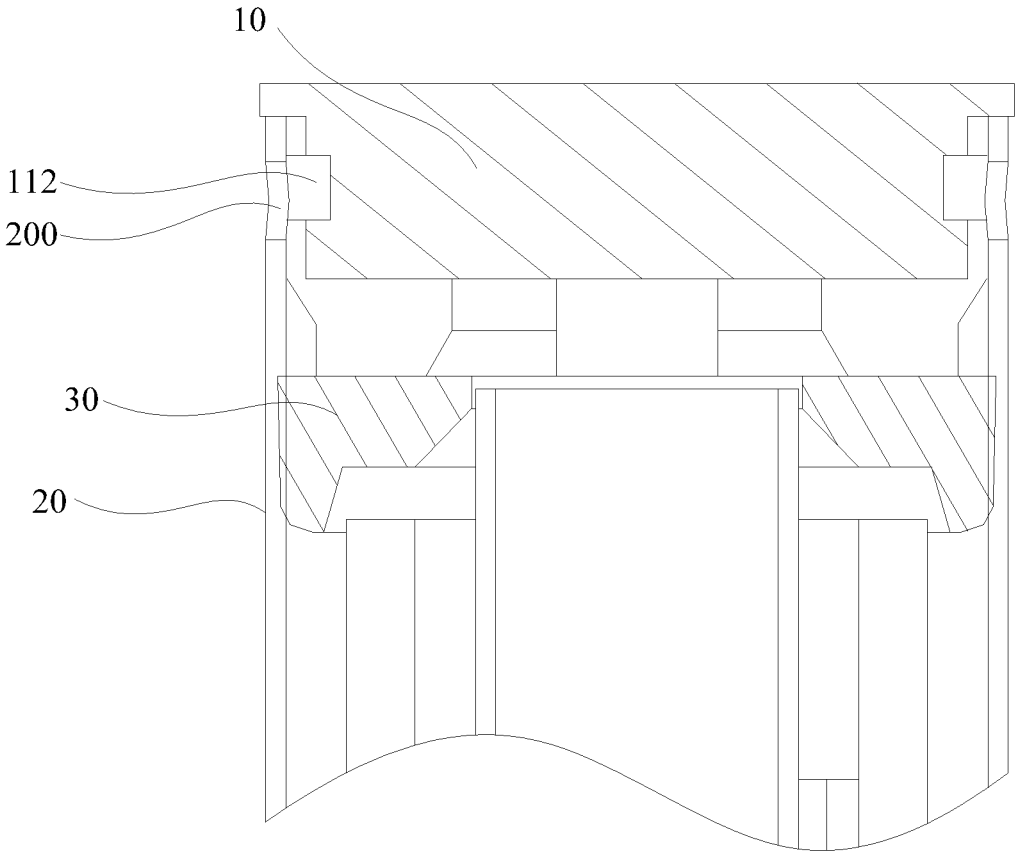
FIG. 2 is a cross-sectional view of the electronic cigarette of FIG. 1.

Referring to FIG. 1 and FIG. 2, preferred embodiment of an electronic cigarette (not labeled) is provided. The electronic cigarette includes a cigarette holder cover 10, a sleeve 20, and a seal ring 30. The sleeve 20 is made of plastic materials such as polycarbonate, polypropylene (PP), poly carbonate (PC) and acrylonitrile butadiene styrene (ABS), paper materials, or wood materials. The cigarette holder cover 10 is made of flexible materials such as silicone and rubber. The sleeve 20 is substantially a hollow cylinder, and the cigarette holder cover 10 and the seal ring 30 are received in the sleeve 20 for sealing the electronic cigarette.

The sleeve 20 defines at least one inhaling hole 200 at the a side surface of an end of sleeve near the cigarette holder cover 10. In the illustrated embodiment, the inhaling hole 20 can be circular, kidney, polygonal, elliptic, or groove shaped. The inhaling hole 200 can be one, two or more, which is configured as need for atomized smoke flow. When there are more than two inhaling holes 200, the inhaling holes 200 can be equally spaced or not. The atomized smoke flow may be small with a few of inhaling holes 200, while the atomized smoke flow may be heavy with a mount of inhaling holes 200. In specific, an area of the all inhaling holes 200 at the periphery of the sleeve 20 is between 2 $mm^2$ and 6 $mm^2$. If the area is less than 2 $mm^2$, the atomized smoke flow may be too small to flow the electronic cigarette, which result in a damage of the electronic cigarette. If the area is more than 6 $mm^2$, the atomized smoke flow may be too heavy to get a good smoking feel.

Figure 3:
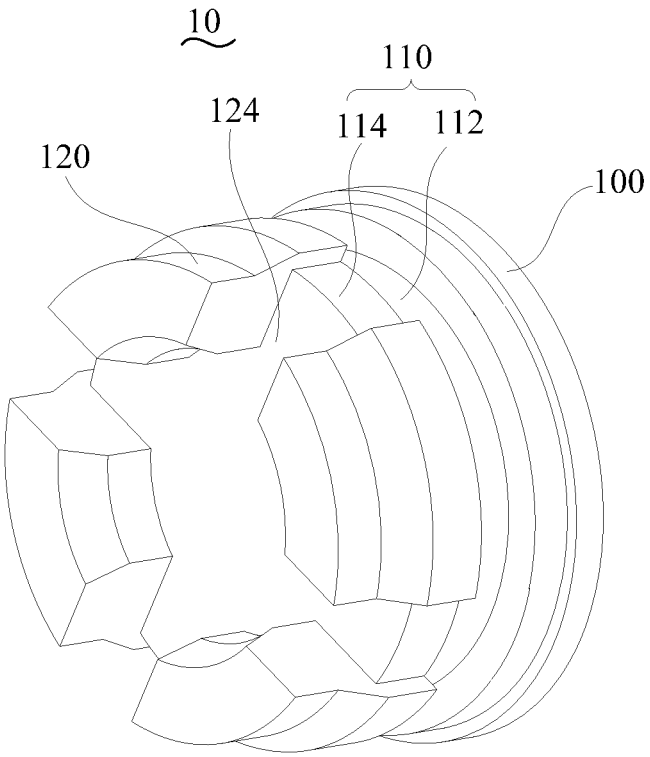
FIG. 3 is an isometric view of a first embodiment of a cigarette holder cover of the electronic cigarette of FIG. 1.

Also referring to FIG. 3, the cigarette holder cover 10 is substantially a cylinder, and includes a cap 100 and a main body 110 extending from the bottom surface of the cap 100 and along a center axis thereof. The diameter of the main body 110 is less than that of the cap 100, and the main body 110 is received in the sleeve 20 and the cap 100 resist against an end of the sleeve 20, thereby the electronic cigarette is sealed.

Referring to FIG. 3, the main body 110 extends from the bottom surface of the cap 100 and along a center axis thereof, and the diameter of the main body 110 is less than that of the cap 100. The main body 110 defines a first groove 112 at an outer surface thereof and a second groove 114 for the atomized smoke flowing. The first groove 112 communicates with the inhaling holes 200 to cooperatively form a channel for the atomized smoke flowing. The atomized smoke can be inhaled from the inhaling holes 200 through the channel at the first groove 112 and the inhaling holes 200. The first groove 112 can be a circular groove defined at an outer surface of the main body 110, and the sleeve 20 can define multiple equally spaced inhaling holes 200 correspondingly, thereby increasing the inhaled atomized smoke. The first groove 112 can also be a U-shaped groove recessed from the surface of the main body 110, and the number of the first groove 112 can be one or more. When there are more than two first grooves 112, the first grooves 112 are spaced from each other corresponding to the inhaling holes 200.

The second groove 114 is defined at one side of the first groove 112 away from the cap 100, and the second groove 114 communicates with the first groove 112 to form a part of the channel. The second groove 114 can be various shapes, such as circular, kidney, polygonal, or other irregular shaped. In the illustrated embodiment, the second grooves 114 are four, substantially U-shaped, and equally spaced. The four second grooves 114 are equidistantly spaced from each other to facilitate the atomized smoke passing through the second groove 114, the first groove 112, and the inhaling holes 200 in turn and being inhaled by a user.

In a first embodiment, the cigarette holder cover 10 further includes a first connecting portion 120 connected with the seal ring 30. The first connecting portion 120 is substantially a cylinder, and defines a third groove 124. The third groove 124 communicates with the second groove 114 for the atomized smoke flowing. In the illustrated embodiment, there are four third grooves 124, and the third grooves 124 are spaced corresponding to the second grooves 114. The first grooves 112, the second grooves 114, and the third grooves 124 cooperatively form a channel for the atomized smoke flowing, and the atomized smoke can be inhaled from the inhaling holes 200 through the channel. It is to be understood that the number and shape of the third grooves 124 can be various, not limited to this embodiment.

In the illustrated embodiment, the cap 100, the main body 110 and the first connecting portion 120 are integrally formed, which is easy to process and is well in the whole effect.

The cigarette holder cover 10 and the sleeve 20 are connected with a buckle connection, which prevents the cigarette holder cover 10 popping from the sleeve 20, and so as to prevent the smoker from swallowing the cigarette holder cover 10. In specific, the first connecting portion 120 has certain buckles (not shown), while the sleeve 20 defines certain notches (not shown) corresponding to the buckles, and the buckles and the notches cooperatively define the buckle connection. In an alternative embodiment, the first connecting portion 120 defines certain notches (not shown), while the sleeve 20 has certain buckles (not shown) corresponding to the notches, and the buckles and the notches cooperatively define the buckle connection.

Figure 4:
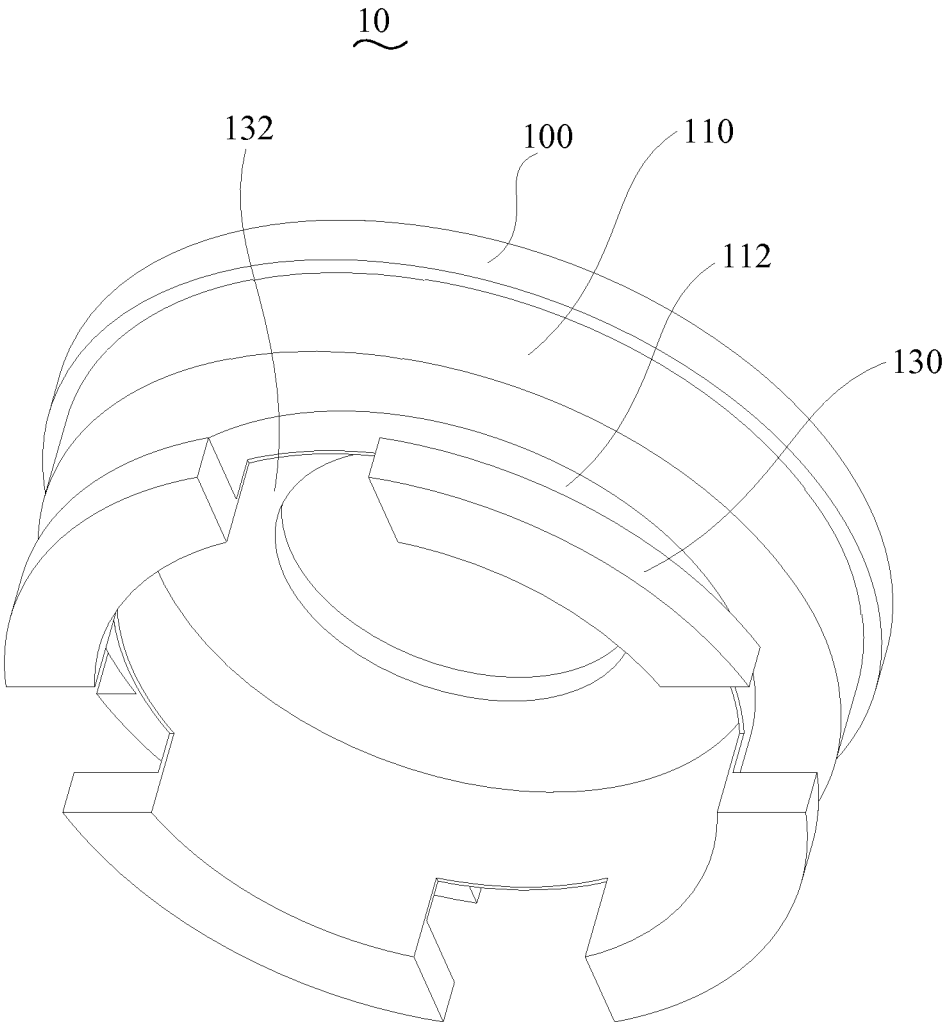
FIG. 4 is an isometric view of a second embodiment of a cigarette holder cover of the electronic cigarette of FIG. 1.

Referring to FIG. 4, it is a second embodiment of a cigarette holder cover 10 of the electronic cigarette. The cigarette holder cover 10 includes a second connecting portion 130 connected with the seal ring 30. The second embodiment differs from the first embodiment only in the second connecting portion 130 being different from the first connecting portion 120. The second connecting portion 130 is substantially a cylinder, and is configured at a side of the first groove 112 opposite to the cap 100. The second connecting portion 130 defines a gap 132 communicated with the first groove 112. In the illustrated embodiment, there are four gaps 132, and the gaps 132 are interval spaced. The atomized smoke can be inhaled by passing through the gaps 132, the first groove 112, and the inhaling holes 200 in turn. The second connecting portion 130 is received in the sleeve by resisting against the seal ring 30, and the gaps 132 can perform buffering when the second connecting portion 130 is extruded. It is to be understood that the number and shape of the gap 132 can be various, not limited to this embodiment.

In the illustrated embodiment, the cap 100, the main body 110 and the second connecting portion 130 are integrally formed, which is easy to process and is well in the whole effect.

The electronic cigarette described-above has many benefits. Because the sleeve 20 defines the at least one inhaling hole 200, and the main body 110 defines the first groove 112, when the cigarette holder cover 10 is embedded within the sleeve 20, the first groove 112 communicates with the inhaling holes 200 to cooperatively form the channel for the atomized smoke flowing, thereby, the atomized smoke will not be inhaled through the centre of the cap 100 but be inhaled through the inhaling holes 200. Namely, the atomized smoke can be inhaled by deflected through certain angle, which avoids inhaling the cigarette liquid and filters small particles contained in the atomized smoke to leave in the electronic cigarette. The present invention prevents the atomized smoke from directly flowing in mouth, which improves the smoker experience.

Figure 5:
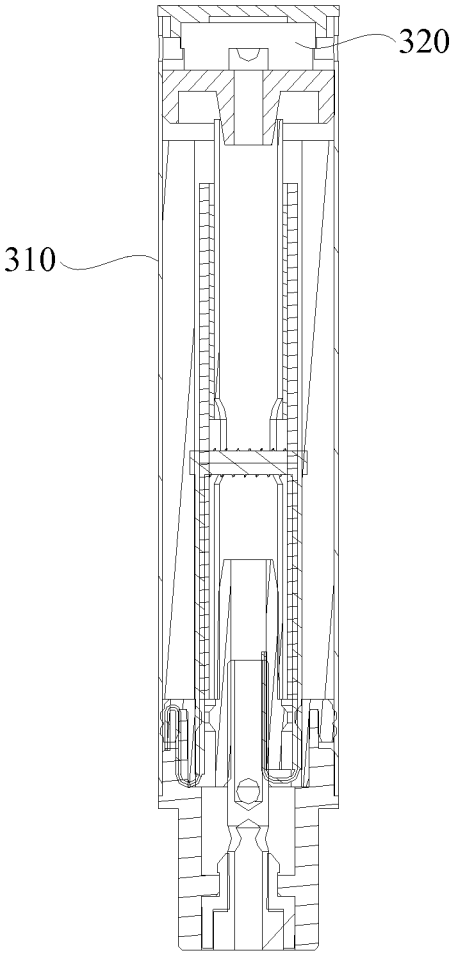
FIG. 5 is a cross-sectional view of a disposable atomizer.

Referring to FIG. 5, a disposable atomizer (not labeled) includes an atomizing sleeve 310 and a cigarette holder cover 320. The atomizing sleeve 310 defines a quantity of inhaling holes (not shown), the configuration of the inhaling holes are substantially the same as the inhaling holes 200. The cigarette holder cover 320 can be the cigarette holder cover 10 illustrated in the first and second embodiment.

It should be emphasized that the above-described embodiments of the present invention, particularly, any preferred embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed is:

1. An electronic cigarette, comprising a sleeve and a cigarette holder cover received in the sleeve, wherein the sleeve defines at least one inhaling hole at a side surface of an end of the sleeve near the cigarette holder cover, and the cigarette holder cover comprises a cap and a main body extending from a bottom surface of the cap; the main body defines a first groove at an outer surface thereof, the first groove is aligned with the inhaling hole of the sleeve to cooperatively form a channel configured for flowing of smoke, and the channel is configured to guide smoke in the electronic cigarette to reach the inhaling hole and inhaled by a user at a joint of the first groove and the inhaling hole;

wherein the main body further defines at least one second groove at a side of the first groove opposite to the cap, and the second groove corresponds to and communicates with the first groove; and wherein the number of the second grooves is four, and the second grooves are spaced from each other.

2. The electronic cigarette of claim 1, wherein the first groove is a circular groove defined at an outer surface of the main body.

3. The electronic cigarette of claim 1, wherein the electronic cigarette further comprises a seal ring, the cigarette holder cover further comprises a first connecting portion connected with the seal ring; and the first connecting portion defines a third groove communicating with the second groove.

4. The electronic cigarette of claim 3, wherein the first connecting portion configures a buckle, an inner surface of the sleeve defines a notch corresponding to the buckle, and the buckle and the notch cooperatively define a buckle connection.

5. The electronic cigarette of claim 3, wherein the first connecting portion defines a notch, an inner surface of the sleeve configures a buckle corresponding to the notch, and the buckle and the notch cooperatively define a buckle connection.

6. The electronic cigarette of claim 3, wherein the cap, the main body and the first connecting portion are integrally formed.

7. The electronic cigarette of claim 1, wherein the inhaling hole is circular, kidney, polygonal, or elliptic shaped.

8. An electronic cigarette, comprising a sleeve and a cigarette holder cover received in the sleeve, wherein the sleeve defines at least one inhaling hole at a side surface of an end of the sleeve near the cigarette holder cover, and the cigarette holder cover comprises a cap and a main body extending from a bottom surface of the cap; the main body defines first groove at an outer surface thereof, the first groove is aligned with the inhaling hole of the sleeve to cooperatively form a channel configured for flowing of smoke, and the channel is configured to guide smoke in the electronic cigarette to reach the inhaling hole and inhaled by a user at a joint of the first groove and the inhaling hole;

wherein the first groove is a circular groove defined at an outer surface of the main body;

wherein the electronic cigarette further comprises a seal ring, the cigarette holder cover further comprises a second connecting portion connected with the seal ring; the second connecting portion defines four gaps, each of the gaps being communicated with the first groove for the atomized smoke flowing; and wherein the gaps are spaced from each other.

9. The electronic cigarette of claim 8, wherein the cap, the main body and the second connecting portion are integrally formed.

* * * * *